US009452439B2

(12) United States Patent
Bolton

(10) Patent No.: US 9,452,439 B2
(45) Date of Patent: Sep. 27, 2016

(54) LIQUID DISPENSING APPARATUS

(71) Applicant: LAJA MATERIALS LIMITED, Isle of Man (GB)

(72) Inventor: Terence W. Bolton, Redhill (GB)

(73) Assignee: Laja Materials Limited (GB)

( * ) Notice: Subject to any disclaimer, the term of this patent is extended or adjusted under 35 U.S.C. 154(b) by 21 days.

(21) Appl. No.: 14/121,669

(22) Filed: Oct. 6, 2014

(65) Prior Publication Data

US 2015/0083826 A1 Mar. 26, 2015

Related U.S. Application Data

(63) Continuation of application No. 12/300,945, filed as application No. PCT/GB2007/001852 on May 17, 2007.

(30) Foreign Application Priority Data

May 17, 2006 (GB) ..... 0609685.3

(51) Int. Cl.

| | |
|---|---|
| ***B05B 9/00*** | (2006.01) |
| ***B05B 7/30*** | (2006.01) |
| ***B05B 11/06*** | (2006.01) |
| ***B05B 7/24*** | (2006.01) |

(52) U.S. Cl.

CPC ..... *B05B 7/2459* (2013.01); *B05B 11/061* (2013.01); *B05B 11/068* (2013.01)

(58) Field of Classification Search

CPC .. B05B 7/2459; B05B 11/068; B05B 11/061

USPC ..... 239/326, 346, 363, 418, 375, 409, 354, 239/143, 433, 434, 426, 592, 601; 261/115

See application file for complete search history.

(56) References Cited

U.S. PATENT DOCUMENTS

| | | | | |
|---|---|---|---|---|
| 185,603 | A | 12/1876 | Wallace | |
| 209,945 | A | 11/1878 | Morey | |
| 327,977 | A | 10/1885 | Bluett | |
| 578,436 | A | 3/1897 | Woodruff | |
| 1,104,217 | A | 7/1914 | Paasche | |
| 1,125,875 | A | 1/1915 | Paasche | |
| 1,166,522 | A * | 1/1916 | Holton | 239/341 |
| 1,272,438 | A | 7/1918 | Heinrich | |
| 1,299,290 | A * | 4/1919 | Berg | 239/346 |
| 1,703,359 | A | 2/1929 | Paasche | |
| 1,891,067 | A * | 12/1932 | Spira | 239/420 |
| 2,357,979 | A | 9/1944 | Schmitt | |
| 2,368,536 | A | 1/1945 | Gersmehl | |
| 3,107,058 | A * | 10/1963 | Corbett | 239/346 |
| 4,020,990 | A * | 5/1977 | Luff | 239/346 |
| 4,079,893 | A | 3/1978 | Bass | |

(Continued)

FOREIGN PATENT DOCUMENTS

| | | | |
|---|---|---|---|
| DE | 181046 | C | 11/1904 |
| FR | 404296 | A | 11/1909 |
| GB | 2273065 | A | 6/1994 |

*Primary Examiner* — Arthur O Hall
*Assistant Examiner* — Steven M Cernoch
(74) *Attorney, Agent, or Firm* — Blank Rome LLP

(57) ABSTRACT

An airbrush having a nozzle (22) through which gas can flow, the end of the nozzle having an inclined surface (30). The apparatus also includes support means for a liquid source (28) which, in use, is directed towards the inclined surface of the nozzle.

16 Claims, 2 Drawing Sheets

(56) References Cited

U.S. PATENT DOCUMENTS

| | | | | |
|---|---|---|---|---|
| 5,190,220 | A | 3/1993 | Bolton | |
| 5,248,096 | A * | 9/1993 | Hoey et al. | 239/272 |
| 5,255,852 | A * | 10/1993 | Morrison | 239/346 |
| 5,687,886 | A | 11/1997 | Bolton | |
| 5,842,646 | A | 12/1998 | Kitajima | |
| 6,341,736 | B1 * | 1/2002 | Liao | 239/375 |
| 6,892,960 | B2 | 5/2005 | Ptak et al. | |
| 7,222,803 | B2 | 5/2007 | Bolton | |
| 7,861,751 | B2 | 1/2011 | McGehee | |
| 2003/0090011 | A1 | 5/2003 | Bolton | |

* cited by examiner

LIQUID DISPENSING APPARATUS

RELATED APPLICATIONS

This application is a Continuation of U.S. patent application Ser. No. 12/300,945 filed on May 8, 2009, which is a National Phase of PCT/GB2007/001852, filed May 17, 2007, which claims the benefit of Great Britain Patent Application No. 0609685.3, filed May 17, 2006, the entire disclosure of which is incorporated by reference herein.

FIELD OF THE INVENTION

This invention relates to apparatus for dispensing a fine spray of liquid particles and more especially, but not exclusively, to liquid dispensers known as airbrushes.

BACKGROUND OF THE INVENTION

GB Patent No. 2273065 describes a hand operated pump which can be connected to a liquid dispensing apparatus with the purpose of supplying air under pressure to a liquid source such as a pen with a nib of absorbent material. The hand pump described in that patent is suitable for use with various forms of liquid dispensing apparatus.

The hand operated pump described in GB 2273065 comprises a bulb of flexible material formed with an open ended neck which locates over the inlet end of the liquid dispensing apparatus. Air enters the bulb via a nozzle in the liquid dispensing apparatus. When the liquid source has been positioned adjacent the nozzle, the flexible bulb is squeezed and the air pushed out onto and over the liquid source directed by the nozzle. When the bulb is released, air is again drawn up through the nozzle of the liquid dispensing apparatus and into the bulb.

An improvement to the pump of GB2273065 is described in GB2357809. In this arrangement, a separate air inlet is provided. This prevents ink being drawn in back through the nozzle, which may otherwise cause large globules of liquid to be dispensed onto the user's substrate.

A disadvantage of the pumps described in GB2357809 is that a relatively high pressure is required in order to obtain sufficient air flow through the nozzle and over the nib to give the desired effect on the apparatus in use. Consequently, the minimum size of the hand-pump is limited which can prevent effective use of the apparatus by young children whose hands are too small to be able to hold and squeeze the hand-pump with sufficient force to provide suitable airflow over the nib. Furthermore, the limitation in the minimum size of the hand-pump provides an apparatus that can appear ungainly and impractical to some potential users.

These problems are alleviated by the provision of a nozzle with an angled opening in accordance with the present invention.

SUMMARY OF THE INVENTION

In accordance with one aspect of the present invention, there is provided an airbrush apparatus comprising a nozzle, one end of the nozzle having an aperture, and the other end of the nozzle having attached thereto means for providing flow of gas through the nozzle and out of the aperture, the apertured end of the nozzle having an inclined surface with respect to the longitudinal axis of the nozzle, the apparatus further comprising support means for releasably holding a liquid source such as a felt-tipped pen, one end of the liquid source, in use, being directed towards the inclined surface of the nozzle.

Preferably, the means of providing flow of gas comprises a hand-operated flexible bulb.

Preferably, the felt-tipped pen is held by the support means such that, in use, the longitudinal axis of the nib of the pen lies generally parallel to the inclined surface of the nozzle.

DETAILED DESCRIPTION OF THE INVENTION

Figure 1:
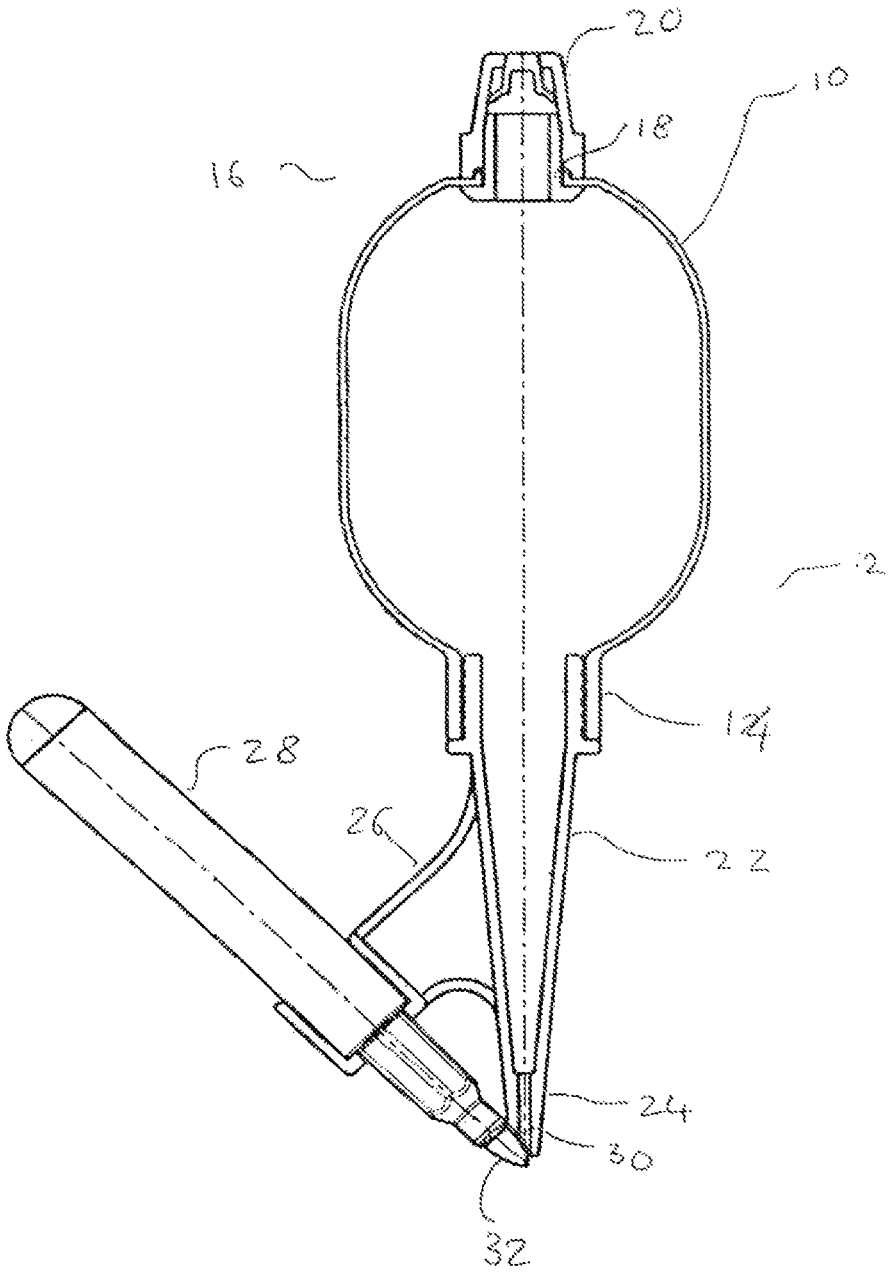
FIG. 1 is a drawing showing an embodiment of the invention.
Figure 2:
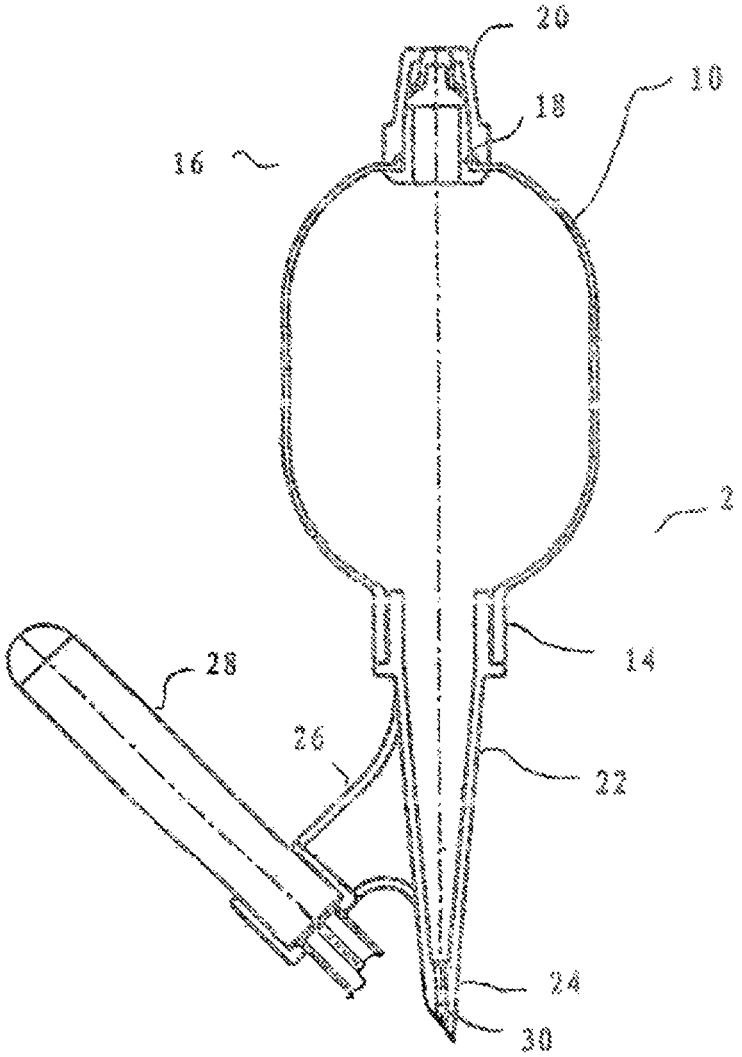
FIG. 2 is a drawing similar to FIG. 1, showing the invention with a portion of the pen of the invention removed.

One embodiment of the present invention will now be described, by way of example, with reference to the accompanying Figure, which shows a hand operated flexible bulb according to the present invention.

As can be seen from the Figure, the bulb 10 comprises a continuous surface of flexible rubber. To one end 12, the bulb 10 has an open-ended neck 14. The other end 16 of the bulb 10 has an aperture 18 which receives an attachment 20 suitably configured to fit within the aperture 18 in an airtight manner. The attachment 20 provides means to connect a further air pump, such as a mechanical or electrical pump (not shown) to the end 16 of the bulb 10.

In a further embodiment (not shown) the bulb does not have an aperture to receive any further attachment.

The neck 14 of the bulb 10 is connected to a first conical nozzle 22. A second nozzle 24 overlaps the end of the first nozzle 22.

The outer surface of the first nozzle 22 has a supporting structure 26 attached thereto that supports and retains a pen 28, such as for example a felt-tipped pen. Alternatively the pen 28 may comprise a cartridge containing a technical drawing pen, the nib of a conventional pen or a pen like cylindrical container including for example, a dip tube through which a colourant such as ink can be withdrawn. Alternatively, edible food colourants, ink based acrylics and emulsified paints may be dispensed by means of the apparatus. A selection of supporting structures 26 may be provided to enable a variety of different liquid sources to be employed.

The supporting structure 26 may, of course, be attached to the outer surface of the first nozzle 22.

The longitudinal axis of the pen 28 is directed and angled towards the apertured end of the second nozzle 24.

The apertured end of the second nozzle 24 is formed with an incline 30 at an angle of between 20 and 60 degrees to the longitudinal axis of the nozzle 24. Preferably the angle of incline is between 40 and 50 degrees. Preferably still, the angle of incline is 45 degrees.

The angle of the incline 30 is designed to correspond with the angle of a nib 32 of the pen 28 when the pen 28 is held within the supporting structure 26 during use. At this time, the slope of the incline 30 is generally perpendicular to the direction of a majority part of the nib 32. In the FIGURE, where the nib 32 is shown to be bullet-shaped, the tip of the nib 32 angles away from the nozzle 24 to form a point. However, the main part of the exposed surface of the nib 32 is held generally parallel to the slope of the incline.

During use air is directed through the apparatus out of the nozzle 24 and into the exposed side surface of the nib 32. Expansion of the air occurs right at the tip of the nib 32 forming a fine spray.

The apertured end of the nozzle 24 with an incline 30 to increase the air flow through the nozzle and over the nib 32 during use. Consequently air can be directed through the apparatus at a lower pressure, which allows the size of the bulb 10 to be substantially reduced and hence more appealing and practical for use by a young child.

Furthermore, low pressure automatic air pumps, such as electrical pumps can be used to provide air flow through the device.

In a further embodiment (not shown) the bulb 10 is replaced by a straw which can be blown through to provide the air flow. The inclination 30 of the apertured end of the nozzle 24 provides sufficient air flow over the nib 32 to enable an effective result, even if a simple straw where to be used.

It will be appreciated that the foregoing is merely exemplary of one embodiment of the pump according to the present invention and of just one form of liquid dispensing apparatus with which it may be used. The skilled reader will understand that modifications can readily be made thereto without departing from the true scope of the invention.

The invention claimed is:

1. A hand held apparatus for producing a spray pattern, comprising:

a frame including an air nozzle and a liquid source holder, each of said air nozzle and liquid source holder having a longitudinal axis, said frame including a connecting portion for holding said air nozzle and said liquid source holder with their respective longitudinal axes at a fixed angular separation, said air nozzle having a first wider end configured to direct air through an airway passage at a second narrower end, said second end being truncated to form an inclined face having a slope of between 20 and 60 degrees to said longitudinal axis of said air nozzle and an angled opening, said slope being generally parallel to said longitudinal axis of said liquid source holder, and said angled opening extending through said inclined face such that said angled opening is in fluid communication with said airway passage of said air nozzle, wherein a liquid source held by said liquid source holder is positioned at said inclined face such that air is directed over said liquid source via said angled opening.

2. A hand held apparatus of claim 1, further comprising a hand operated, flexible bulb sealably connected to said first wider end of said air nozzle and configured to direct air under pressure through said airway passage and angled opening of said air nozzle.

3. A hand held apparatus of claim 1, further comprising a mouthpiece and a conduit connected to said first wider end of said air nozzle, said mouthpiece and said conduit configured to allow an operator to blow air through said air nozzle.

4. A hand held apparatus of claim 1, wherein said liquid source includes an edible food colorant.

5. A hand held apparatus of claim 1, wherein:

said slope of said inclined face is between 40 and 50 degrees with respect to said longitudinal axis of said air nozzle.

6. A hand held apparatus of claim 1, wherein said connecting portion of said frame is substantially rigid.

7. A hand held apparatus for producing a spray pattern, comprising:

a frame including an air nozzle and a pen holder, each of said air nozzle and pen holder having a longitudinal axis, said frame including a substantially rigid connecting portion for holding said air nozzle and said pen holder with their respective longitudinal axes at a fixed angular separation, said air nozzle having a first wider end configured to direct air through an airway passage at a second narrower end, said second end being truncated to form an inclined face having a slope of between 20 and 60 degrees to said longitudinal axis of said air nozzle and an angled opening, said slope being generally parallel to said longitudinal axis of said pen, said angled opening extending through said flat inclined face such that said angled opening is in fluid communication with said airway passage of said air nozzle; and a pen disposed in said pen holder, said pen having a nib, wherein an exposed surface of said nib is held in close proximity to said angled opening of said air nozzle and is positioned generally parallel to said slope of said inclined face of said air nozzle such that air is directed over said nib via said angled opening.

8. A hand held apparatus of claim 7, wherein said pen is a felt tipped pen.

9. A hand held apparatus of claim 7, further comprising:

a hand operated, flexible bulb sealably connected to said first wider end of said air nozzle and configured to direct air under pressure through said airway passage and angled opening of said air nozzle.

10. A hand held apparatus of claim 7, further comprising a mouthpiece and a conduit connected to said first wider end of said air nozzle, said mouthpiece and said conduit configured to allow an operator to blow air through said air nozzle.

11. A hand held apparatus of claim 7, wherein said pen dispense an edible food colorant.

12. A hand held apparatus of claim 7, wherein said slope of said inclined face is between 40 and 50 degrees with respect to said longitudinal axis of said air nozzle.

13. A hand held apparatus for producing a spray pattern, comprising:

a frame including an air nozzle and a pen holder, each of said air nozzle and pen holder having a longitudinal axis, said frame including a connecting portion for holding said air nozzle and said pen holder with their respective longitudinal axes at a fixed angular separation, said air nozzle having a first wider end configured to direct air through an airway passage at a second narrower end, said second end being truncated to form an inclined face having a slope and an angled opening, and said angled opening extending through said inclined face such that said angled opening is in fluid communication with said airway passage of said air nozzle; and a pen disposed in said pen holder, said pen having a nib, wherein said pen is held in close proximity to said angled opening, thereby allowing air to be directed over said nib via said angled opening.

14. A hand held apparatus for dispensing a fine spray of liquid particles from a pen-like container having a nib, the apparatus comprising:

a frame including an air nozzle comprising first and second nozzles and a holder for the pen-like container, the air nozzle and the holder each having a longitudinal axis;

a substantially rigid supporting structure for holding the air nozzle and the pen-like container with their respective longitudinal axes at a fixed angular separation; and means for providing a flow of air through the air nozzle, wherein the first nozzle is configured to direct air into and through the second nozzle, wherein the second nozzle has an apertured end which is truncated to form an inclined face having a slope, wherein the inclined face comprises an inclined opening against which the nib of the pen-like container is positioned such that the air is directed over the nib of the pen-like container via the inclined opening, and wherein a portion of an exposed surface of the nib is held substantially parallel to the slope of the inclined face.

15. A hand held apparatus of claim 14, wherein the slope of the inclined face is between 20 and 60 degrees with respect to said longitudinal axis of said air nozzle.

16. A hand held apparatus of claim 14, wherein the slope of the inclined face is between 40 and 50 degrees with respect to said longitudinal axis of said air nozzle.

* * * * *